US005564900A

United States Patent [19]

McAuley

[11] Patent Number: 5,564,900

[45] Date of Patent: Oct. 15, 1996

[54] FAN BLADE COVER SLIP

[75] Inventor: Becky J. McAuley, Stromsburg, Nebr.

[73] Assignee: LCRM Consulting, Inc., Stromsburg, Nebr.

[21] Appl. No.: 550,210

[22] Filed: Oct. 30, 1995

[51] Int. Cl.[6] ..... F04D 29/00

[52] U.S. Cl. ..... 416/62; 416/5; 38/140; 239/289; 261/84; 261/DIG. 65; 422/124; 55/467; 55/471

[58] Field of Search ..... 416/5, 62, 146 R; 150/54; 4/245.5; 247/228.11, 228.12.228.13; 38/140; 261/84, DIG. 65; 239/289; 15/229.3, 229.4, 229.7, 229.8, 244.3, 247; 422/124; 55/467, 471, 473

[56] References Cited

U.S. PATENT DOCUMENTS

| | | | |
|---|---|---|---|
| 2,418,969 | 4/1947 | Di Gesare | 38/140 |
| 4,676,721 | 6/1987 | Hardee | 416/62 |
| 5,281,093 | 1/1994 | Sedlak et al. | 416/62 |
| 5,370,721 | 12/1994 | Carnahan | 416/62 |

FOREIGN PATENT DOCUMENTS

| | | | |
|---|---|---|---|
| 8200942 | 10/1983 | Netherlands | 38/140 |

*Primary Examiner*—Edward K. Look
*Assistant Examiner*—Christopher Verdier
*Attorney, Agent, or Firm*—Zarley, McKee, Thomte Voorhees & Sease; Mark D. Frederiksen

[57] ABSTRACT

A fan blade cover slip is removably secured to each blade of a ceiling fan with fabric extending over the lower face of each blade to substantially cover the lower face of each blade. Each cover slip includes an elongated fabric sheet having longitudinal edges folded over the upper face of a blade to form longitudinal flaps, and with an outward end folded over the upper surface of the fan blade to form an outward end flap. A cord is journaled through a sleeve formed along the longitudinal edges and the outward end of the fabric sheet, with ends projecting out inward ends of the longitudinal sleeves. The projecting ends of the cord are pulled tight and then fastened together to secure the cover slip to the fan blade. An opening is formed generally midway along each longitudinal sleeve, with the cord crossing over from an inward sleeve on one side to the outward sleeve on the opposing longitudinal edge at the openings, to further secure the cover slip on the fan blade. A strip of absorptive material is attached between the longitudinal flaps, and a fragrance oil is applied to the strip to circulate fragrance or air freshener throughout a room upon activation of the fan.

9 Claims, 2 Drawing Sheets

FAN BLADE COVER SLIP

TECHNICAL FIELD

The present invention relates generally to overhead ceiling fans, and more particularly to room decor including a cover slip for fan blades.

BACKGROUND OF THE INVENTION

Various fabric accessories are utilized throughout a home to provide a particular room decor. Such accessories include drapes and valances for windows, printed paper for walls and/or ceilings, wood trim and chair rails, throw pillows, and various other items. Often, the home owner will attempt to coordinate various room accessories and furniture, such that the curtain and valance fabric matches or complements the fabric on furniture within the room.

The addition of a ceiling fan to a room can detract from the room decor, because the fan blades have either a woodgrain pattern or a painted surface, which do not complement or match the fabrics of furniture within the room.

Although ceiling fans are now available in a variety of styles, the fan blades are not formed of fabric which can be matched to furniture within the room.

SUMMARY OF THE INVENTION

It is therefore a general object of the present invention to provide the blades of a ceiling fan with fabric cover slips which may be matched to room furniture.

Another object is to provide fan blade cover slips which may be easily installed and removed from fan blades.

Yet another object is to provide fan blade cover slips which may be fastened to fan blades to provide a refined appearance to the fan.

These and other objects will be apparent to those skilled in the art.

The fan blade cover slip of the present invention is removably secured to each blade of a ceiling fan with fabric extending over the lower face of each blade to substantially cover the lower face of each blade. Each cover slip includes an elongated fabric sheet having longitudinal edges folded over the upper face of a blade to form longitudinal flaps, and with an outward end folded over the upper surface of the fan blade to form an outward end flap. A cord is journaled through a sleeve formed along the longitudinal edges and the outward end of the fabric sheet, with ends projecting out inward ends of the longitudinal sleeves. The projecting ends of the cord are pulled tight and then fastened together to secure the cover slip to the fan blade. An opening is formed generally midway along each longitudinal sleeve, with the cord crossing over from an inward sleeve on one side to the outward sleeve on the opposing longitudinal edge at the openings, to further secure the cover slip on the fan blade. A strip of absorptive material is attached between the longitudinal flaps, and a fragrance oil is applied to the strip to circulate fragrance or air freshener throughout a room upon activation of the fan.

DESCRIPTION OF THE PREFERRED EMBODIMENT

Figure 1:
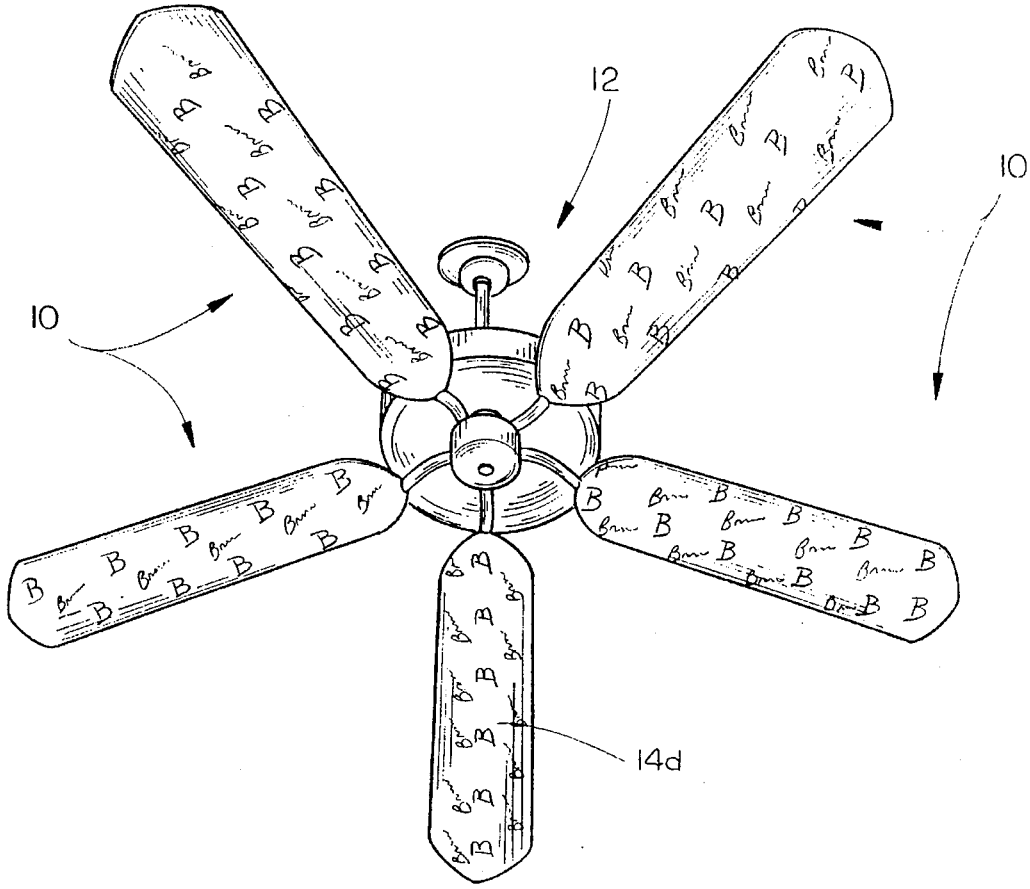
FIG. 1 is perspective view of a ceiling fan showing the cover slips of the present invention installed on the fan blades.

Referring now to the drawings, in which similar or corresponding parts are identified with the same reference numeral, and more particularly to FIG. 1, the fan blade cover slips of the present invention are identified generally at 10 and are shown attached to the blades of a conventional ceiling fan 12.

Figure 2:
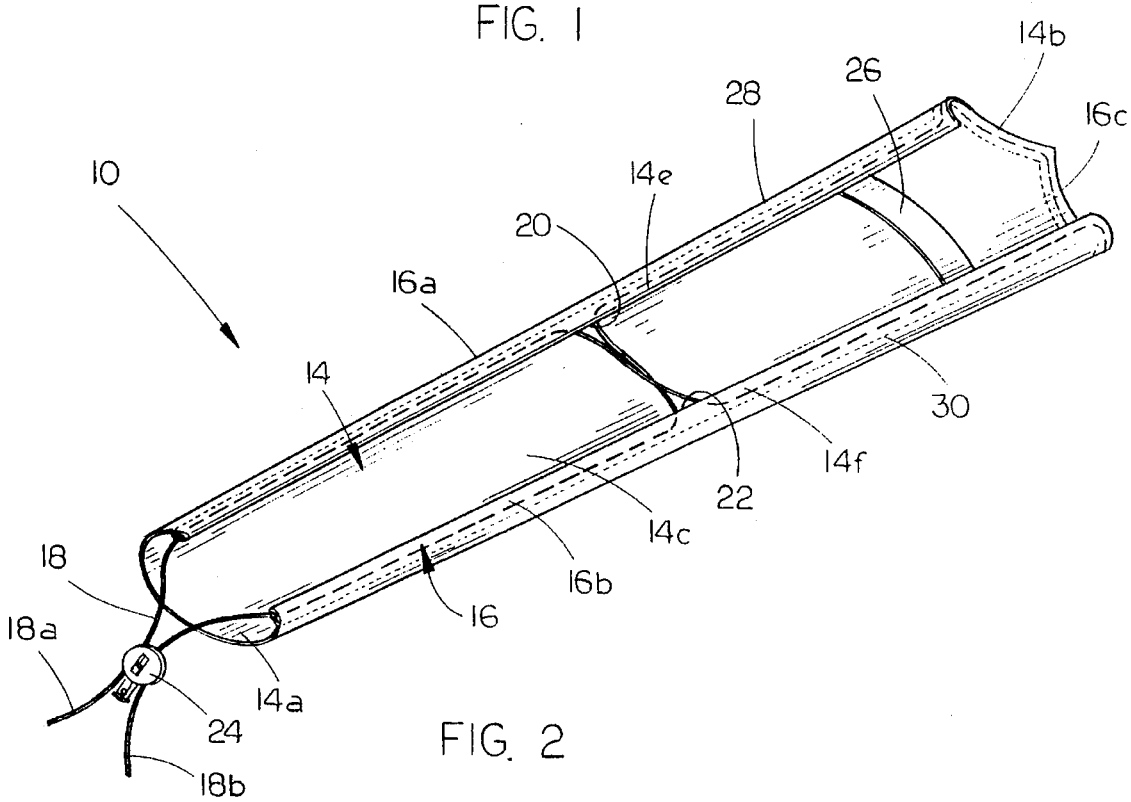
FIG. 2 is an enlarged perspective view of one fan blade cover slip prior to being fastened to a fan blade.

Referring now to FIG. 2, each slip cover 10 is formed from an elongated fabric sheet 14 having an inward end 14*a*, an outward end 14*b*, an upper face 14*c*, a lower face (shown in FIG. 1) 14*d* and opposing longitudinal edges 14*e* and 14*f*. Lower face 14*d* of the fabric sheet 14 is preferably the face having the desired design, print, or other "display surface", so as to be directed downwardly when fastened to a fan blade. The width of fabric sheet 14, measured between longitudinal edges 14*e* and 14*f* preferably increases from inward end 14*a* to outward end 14*b* so as to correspond with the typical tapered width of a fan blade. A sleeve 16 is formed along longitudinal edge 14*e*, extends along outward end 14*b*, and continues along longitudinal edge 14*f*, to receive a securement cord 18 therethrough. Sleeve 16 may thereby be defined with two longitudinally extending portions 16*a* and 16*b*, extending along longitudinal edges 14*e* and 14*f* respectively, and an end portion 16*c* extending along sheet end 14*b*.

As shown in FIG. 2, longitudinal portions 16*a* and 16*b* of sleeve 16 each have an opening 20 and 22 respectively, therein, permitting cord 18 to exit the longitudinal sleeve portion. Cord 18 has opposing ends 18*a* and 18*b* projecting out of the inward ends of longitudinal sleeve portions 16*a* and 16*b* . Cord 18 is threaded through the inward half of longitudinal sleeve portion 16*a*, exits through opening 20 and crosses over to opening 22 whereupon the cord is journaled through the outward half of longitudinal sleeve portion 16*b*, thence through sleeve end portion 16*c*, the outward half of longitudinal sleeve portion 16*a*, exiting through opening 20, entering opening 22, and finally journaled through the inward half of sleeve longitudinal portion 16*b* to project out the inward end thereof.

A selectively lockable fastener 24 is threaded on the projecting ends 18*a* and 18*b* or cord 18 and is operable to selectively lock onto cord 18. Longitudinal edges 14*e* and 14*f* are preferably folded towards one another adjacent the upper face 14*c* of sheet 14 to form longitudinal flaps 28 and 30 respectively. A highly absorptive strip 26 is affixed between flaps 28 and 30, as shown in FIG. 2.

Figure 3:
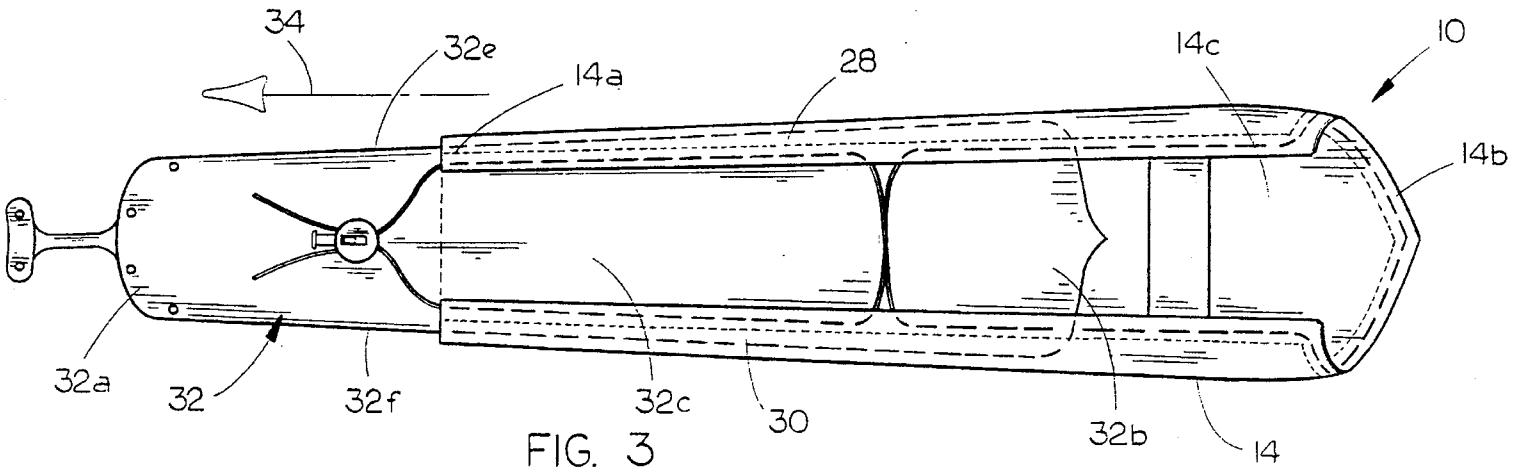
FIG. 3 is a top elevational view of a cover slip being attached to a fan blade.

Referring now to FIG. 3, cover slip 10 may be simply and quickly applied to a conventional fan blade 32, as described hereinbelow.

As mentioned above, fan blade 32 conventionally tapers from a narrow width at an inward end 32*a* to a greater width at an outward end 32*b*. Fan blade 32 includes an upper face 32*c*, a lower face, and opposing longitudinal edges 32*e* and 32*f*.

Figure 4:
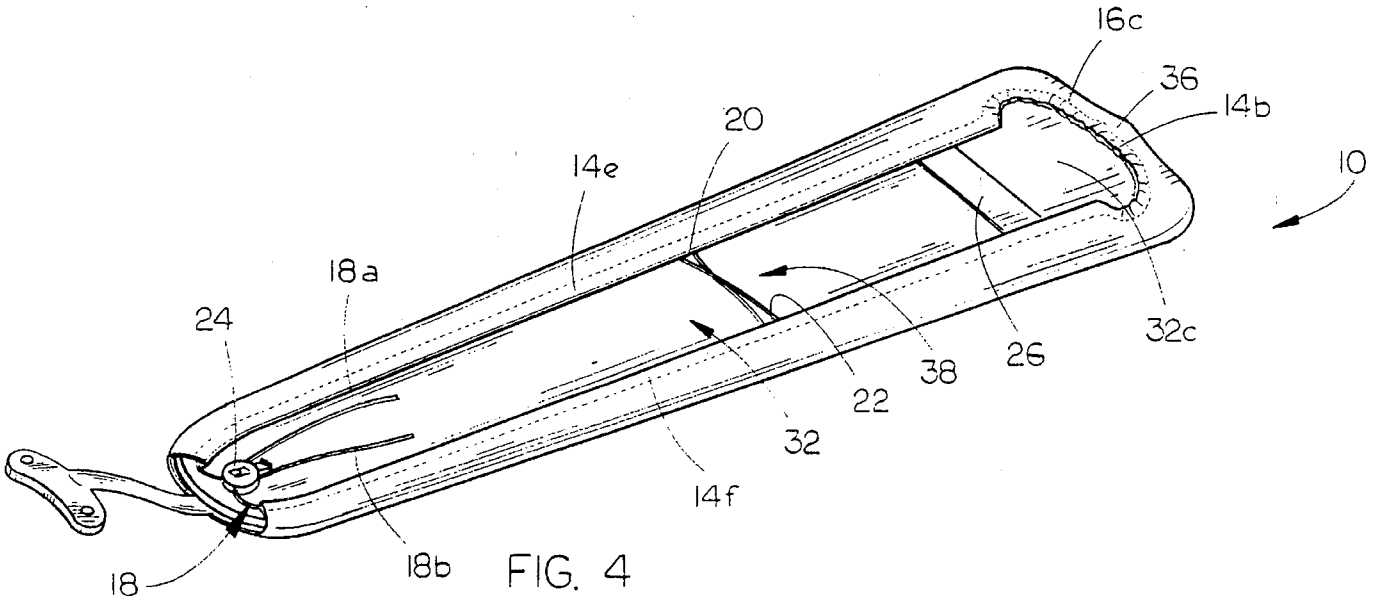
FIG. 4 is a perspective view from the upper side of a fan blade with the cover slip of the present invention attached thereto.

The outward end 32*b* of fan blade 32 is inserted under the inward end of flaps 28 and 30, and above the upper face 14*c* of fabric sheet 14. Cover slip 10 is then moved inwardly along fan blade 32 as shown by arrow 34 until the inward end 14*a* of sheet 14 reaches the inward end 32*a* of fan blade 32. Preferably, cover slip 10 has a length longer than the length of fan blade 32 such that an end flap 36 may be formed by folding outward end 14*b* of sheet 14 over the upper face 32*c* of fan blade 32, as shown in FIG. 4. Cover slip 10 is tightened into position covering the lower face of fan blade 32 by pulling inwardly on the projecting ends 18*a* and 18*b* of cord 18. The "crossover" 38 formed by cord 18 extending between openings 20 and 22 pulls longitudinal edges 14*e* and 14*f* towards one another to form a wrinkle free lower surface 14*d* (shown in FIG. 1) on fan blade 32. Similarly, sleeve end portion 16*c* formed in flap 36 will be drawn inwardly by pulling on cord ends 18*a* and 18*b* so as to pull the lower face 14*d* (shown in FIG. 1) of fabric sheet 14 taut, in the longitudinal direction. With cord 18 pulled taut, fastener 24 is locked into position on cord 18 to retain cover slip 10 in a wrinkle free condition tight on fan blade 32.

Removal of cover slip 10 may be easily accomplished by simply unlocking fastener 24 to loosen cord 18 thereby permitting cover slip 10 to be slipped off the outward end of fan blade 32.

Fabric strip 26 is provided to retain liquid fragrance and circulate the fragrance throughout the room. A few drops of liquid fragrance may be applied to strip 26, which absorbs the liquid in the absorptive material. Activation of the ceiling fan causes air to circulate over strip 26, thereby circulating the fragrance throughout a room, quickly and effectively.

Whereas the invention has been shown and described in connection with the preferred embodiment thereof, many modifications, substitutions and additions may be made which are within the intended broad scope of the appended claims. For example, while sleeve 16 is shown as a continuous sleeve, except for openings 20 and 22, the sleeve could be formed of a series of spaced apart loops through which cord 18 is journaled. Similarly, while one crossover 38 is shown tying longitudinal sleeve portions 16*a* and 16*b* together, additional crossovers could be utilized to more securely fasten cover slip 10 to the fan blade. In addition, fastener 24 is the preferred method for locking the cord ends 18*a* and 18*b* in the pulled taut condition. However, this same function could be accomplished by simply tying cord ends 18*a* and 18*b* together, or utilizing other similar fasteners.

I claim:

1. A cover slip for a ceiling fan blade, comprising:

an elongated fabric sheet having inward and outward ends, longitudinal edges, a display face and an opposing back face;

sleeve means formed along the longitudinal edges and the outward end of said sheet, for retaining a cord along said edges and outward end;

the longitudinal edges of said sheet folded back over the sheet back to form opposing longitudinal flaps;

the outward end of said sheet folded back over the sheet back to form an end flap;

a cord threaded through said sleeve means, having opposing ends projecting from inward ends of the sleeve means on the sheet longitudinal edges; and means for selectively releasably securing the projecting ends of the cord together; said sleeve means further including:

a first continuous longitudinal sleeve formed along one longitudinal sheet edge, having an opening formed therein generally midway between inward and outer ends of the first sleeve to form a first inward sleeve half generally coaxial with a first outward sleeve half;

a second continuous longitudinal sleeve formed along the opposing longitudinal sheet edge, having an opening formed therein generally midway between inward and outer ends of the second sleeve to form a second inward sleeve half generally coaxial with a second outward sleeve half;

a continuous sleeve formed along the outward end of the sheet, extending between the outward ends of the first and second outward sleeve halves; and wherein said cord is journaled through the first inward sleeve half, thence between the first and second sleeve openings, thence through the second outward sleeve half, thence through the end sleeve, thence through the first outward sleeve half, thence between the first and second sleeve openings, and thence through the second inward sleeve half.

2. The cover slip of claim 1, wherein the width of the sheet, as measured between the longitudinal edges, increases from the inward end to the outward end.

3. The cover slip of claim 1, wherein said means for selectively securing the cord ends includes a selectively lockable mechanical fastener.

4. The cover slip of claim 1, further comprising a strip of liquid absorptive material fastened between the longitudinal flaps of the sheet.

5. In combination:

a ceiling fan having a plurality of radially extending blades, each blade having an inward end, an outward end, opposing longitudinal side edges and upper and lower faces; and a fabric cover slip removably secured to each fan blade and covering substantially the entire lower face of each blade;

each cover slip including:

an elongated sheet having inward and outward ends, longitudinal side edges, a display face and a back face, and having a length and width greater than the length and width of the fan blade to which it is attached;

sleeve means formed along the longitudinal edges and the outward end of said sheet, for retaining a cord along said edges and outward end;

the back face of the sheet secured against the lower face of the blade, with the longitudinal edges of the sheet folded over the upper face of the blade to form longitudinal flaps extending towards one another, and with the outward end of the sheet folded over the upper face of the blade to form an end flap extending towards the inward end of the blade;

a cord threaded through said sleeve means, having opposing ends projecting from inward ends of the sleeve means on the sheet longitudinal edges; and means for selectively releasably securing the projecting ends of the cord together;

said sleeve means further including:

a first continuous longitudinal sleeve formed along one longitudinal sheet edge, having an opening formed therein generally midway between inward and outer ends of the first sleeve to form a first inward sleeve half generally coaxial with a first outward sleeve half;

a second continuous longitudinal sleeve formed along the opposing longitudinal sheet edge, having an opening formed therein generally midway between inward and outer ends of the second sleeve to form a second inward sleeve half generally coaxial with a second outward sleeve half;

a continuous sleeve formed along the outward end of the sheet, extending between the outward ends of the first and second outward sleeve halves; and said cord being journaled through the first inward sleeve half, thence between the first and second sleeve openings, thence through the second outward sleeve half, thence through the end sleeve, thence through the first outward sleeve half, thence between the first and second sleeve openings, and thence through the second inward sleeve half.

6. The combination of claim 5, further comprising an absorptive strip of material connected to at least one cover slip, with liquid fragrance absorbed thereon.

7. The combination of claim 6, wherein said strip is fastened between the longitudinal flaps of said cover slip.

8. The combination of claim 5, wherein the fan blade increases from the inward end to the outward end, and wherein the width of the sheet increases from the inward end to the outward end.

9. The combination of claim 5, wherein said means for selectively securing the cord ends is a selectively lockable mechanical fastener.

* * * * *